US007333763B2

(12) United States Patent
Choi

(10) Patent No.: US 7,333,763 B2
(45) Date of Patent: Feb. 19, 2008

(54) DEVELOPER COLLECTING APPARATUS AND AN IMAGE FORMING APPARATUS HAVING THE SAME

(75) Inventor: Jeong-Jai Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 144 days.

(21) Appl. No.: 11/198,315

(22) Filed: Aug. 8, 2005

(65) Prior Publication Data

US 2006/0062614 A1 Mar. 23, 2006

(30) Foreign Application Priority Data

Sep. 22, 2004 (KR) ..... 10-2004-0075836

(51) Int. Cl.
*G03G 21/10* (2006.01)

(52) U.S. Cl. ..... 399/358; 399/98

(58) Field of Classification Search ..... 399/358, 399/359, 98, 99

See application file for complete search history.

(56) References Cited

U.S. PATENT DOCUMENTS 5,113,227 A * 5/1992 Miyasaka ..... 399/358
5,481,351 A * 1/1996 Kawai et al. ..... 399/359
6,266,511 B1 * 7/2001 Murakami et al. ..... 399/358
6,366,755 B1 * 4/2002 Takashima ..... 399/359 X
2005/0286941 A1 * 12/2005 Lee ..... 399/359

FOREIGN PATENT DOCUMENTS

| | | | |
|---|---|---|---|
| JP | 05-027652 A | * | 2/1993 |
| JP | 10-333517 | | 12/1998 |
| JP | 2001-083774 | | 3/2001 |
| JP | 2001-350382 | | 12/2001 |
| KR | 1996-024404 | | 7/1996 |
| KR | 1999-029393 | | 4/1999 |
| KR | 10-2003-0017913 | | 3/2003 |
| KR | 2003-017913 | | 3/2003 |

* cited by examiner

*Primary Examiner*—Sophia S. Chen
(74) *Attorney, Agent, or Firm*—Roylance, Abrams, Berdo & Goodman, L.L.P.

(57) ABSTRACT

Disclosed is a developer collecting apparatus capable of preventing a developer collected from a photoconductive medium from clotting while being supplied to a developing unit. The developer collecting apparatus includes a developer collecting container including an inlet for inflow of a developer removed from a photoconductive medium by a cleaning member, and an outlet for discharge of the developer. The developer collecting apparatus also includes a developer storing container connected to the developer collecting container through a transport pipe and a vibration unit for preventing the developer from clotting and accumulating at the outlet of the developer collecting container and in the transport pipe.

18 Claims, 4 Drawing Sheets

DEVELOPER COLLECTING APPARATUS AND AN IMAGE FORMING APPARATUS HAVING THE SAME

CROSS-REFERENCE TO RELATED APPLICATIONS

This application claims benefit under 35 U.S.C. § 119(a) of Korean Patent Application No. 2004-75836, filed Sep. 22, 2004, the entire contents of which are hereby incorporated by reference.

BACKGROUND OF THE INVENTION

1. Field of the Invention

The present invention relates to an image forming apparatus. More particularly, the present invention relates to an image forming apparatus having a developer collecting apparatus to recycle unused developer during a transferring process.

2. Description of the Related Art

Image forming apparatuses such as an electrophotographic printer form an electrostatic latent image on a photoconductive medium using a laser scanning system. Image forming apparatuses make a visible image by developing the electrostatic latent image with a developing device and fuse the visible image onto a printing medium.

After the transfer of the visible image, the image forming apparatus withdraws developer of the photoconductive medium, which is not transferred onto the printing medium, by a cleaning member. The withdrawn developer is collected into a developer collecting container. The withdrawn developer is then moved to an outlet formed on one side of the developer collecting container by a first transport member such as an auger. The first transport member is typically mounted on the developer collecting container. Then, the developer is moved to a developer storing container for storing a developer to be supplied to the photoconductive medium through a transport pipe connected to the outlet. The moved developer is supplied, for developing, to the photoconductive medium by a second transport member. The second transport member, such as an auger, is mounted on the developer storing container.

However, while the developer is withdrawn from the photoconductive medium, surfaces of the developer particles are worn away by the cleaning member. Thus, the density of the developer is increased. This may cause the developer to clot in the outlet of the developer collecting container and the transport pipe.

Accordingly, there is a need for an image forming apparatus with an improved developer collecting apparatus which prevents adhesion of developer in an developer collection container outlet and a transport pipe.

SUMMARY OF THE INVENTION

An aspect of the present invention is to solve at least the above problems and/or disadvantages and to provide at least the advantages described below. Accordingly, an aspect of the present invention is to provide an image forming apparatus having a developer collecting apparatus capable of preventing adhesion of a developer to an outlet and a transport pipe.

In order to achieve the above-described aspects of the present invention, there is provided a developer collecting apparatus comprising a developer collecting container including an inlet for inflow of a developer removed from a photoconductive medium by a cleaning member, and an outlet for discharge of the developer, a developer storing container connected to the developer collecting container through a transport pipe, and a vibration unit for preventing the developer from clotting and accumulating at the outlet of the developer collecting container and in the transport pipe.

According to an embodiment of the present invention, the developer collecting apparatus comprises a first transport member mounted in the developer collecting container to move the developer drawn in through the inlet and a second transport member mounted in the developer storing container. The first and the second transport members respectively comprise an auger. The vibration unit comprises a vibrator mounted in the transport pipe to shake the developer and a vibrator driver transmitted with power from the first transport member to thereby vibrate the vibrator.

The vibrator comprises a vibrator body and a connection rib connected to the vibrator body at one end thereof. A vibration rib is connected to the other end of the connection rib. The vibrator driver comprises a pulley which rotates in connection with a shaft of the first transport member and has at least one cam part on one side thereof. A vibrating rod engages with the vibrator body to contact with the one side of the pulley. A spring is interposed between the vibrator body and an inner surface of the transport pipe to resiliently support the vibrator body in one direction.

An upper end of the vibration rib extends substantially upwards toward an inside of the developer collecting container through the outlet. At least a portion of the vibration rib is disposed between a central portion and a lower inner surface of the transport pipe.

Another aspect of the present invention is achieved by providing an image forming apparatus comprising a photoconductive medium whereon a predetermined electrostatic latent image is formed. Also provided is a developing unit for developing the electrostatic latent image on the photoconductive medium into a visible image, a transfer unit for transferring the visible image onto a printing paper, and a developer collecting apparatus for withdrawing a developer unused during the transferring process and remaining on the photoconductive medium to the developing unit. The developer collecting apparatus includes a cleaning member for removing the developer remaining on the photoconductive medium, a developer collecting container having an inlet for inflow of the removed developer and an outlet for discharge of the developer, a developer storing container connected to the developer collecting container through a transport pipe, and a vibration unit for shaking the developer to prevent the developer from clotting and accumulating at the outlet of the developer collecting container and in the transport pipe.

Other objects, advantages, and salient features of the invention will become apparent to those skilled in the art from the following detailed description, which, taken in conjunction with the annexed drawings, discloses preferred embodiments of the invention.

BRIEF DESCRIPTION OF THE DRAWING FIGURES

The above and other objects, features, and advantages of certain embodiments of the present invention will be more apparent from the following description taken in conjunction with the accompanying drawings, in which.

DETAILED DESCRIPTION OF THE EXEMPLARY EMBODIMENT

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
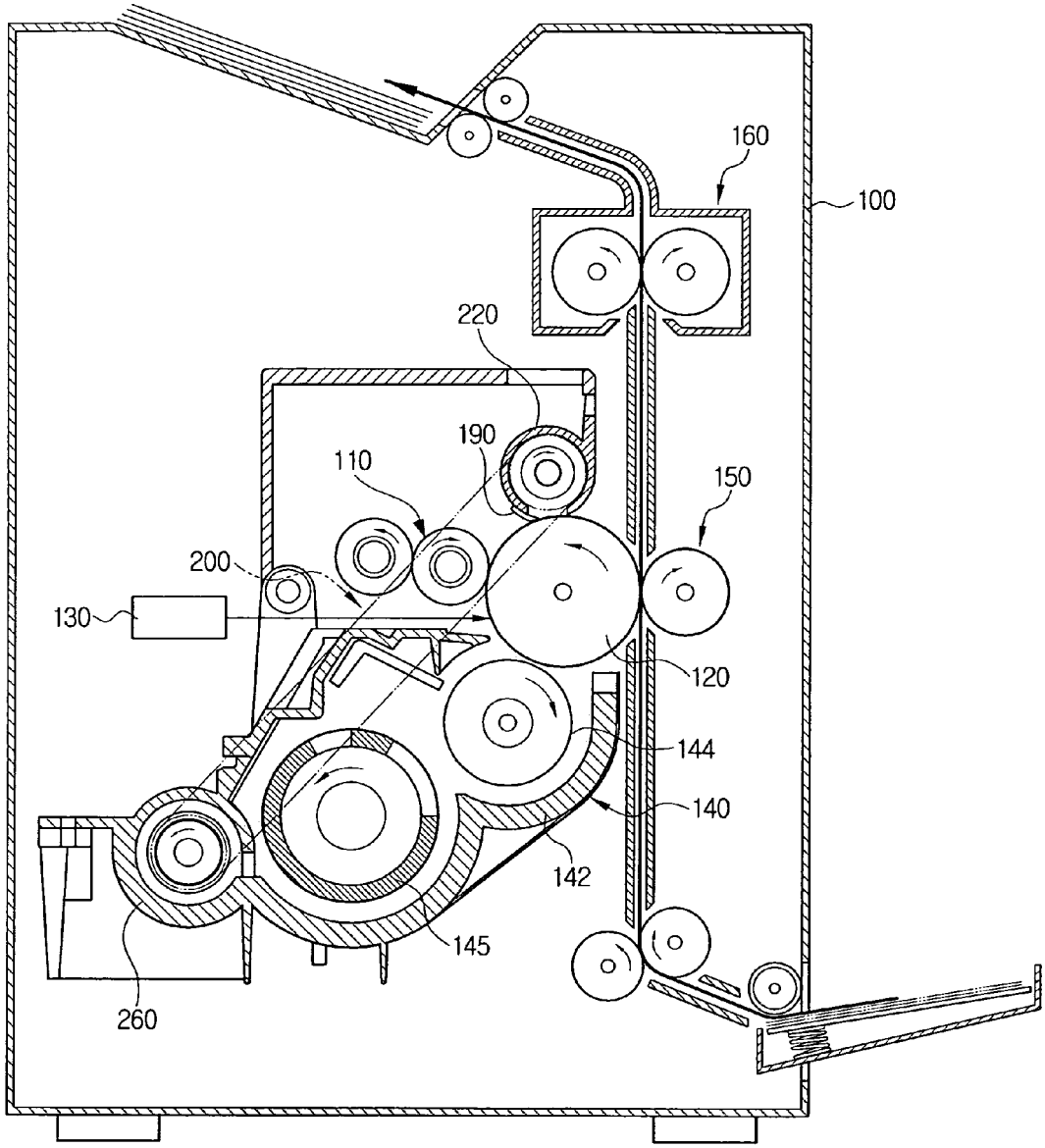
FIG. 1 is a longitudinal sectional view of an image forming apparatus in accordance with an embodiment of the present invention.

Referring to FIG. 1, the image forming apparatus comprises an electrifying unit 110 mounted on a main body 100 of the image forming apparatus to electrically charge a photoconductive medium 120 to a certain electric potential. A laser scanning unit 130 is provided for scanning the electrified photoconductive medium 120 by a laser beam to thereby form an electrostatic latent image. A developing unit 140 is also provided for developing the electrostatic latent image to a visible image. Consequently, a transferring unit 150 transfers the visible image onto a printing medium and a developer collecting apparatus 200 collects unused developer removed from the photoconductive medium 120 by a cleaning member 190. Lastly, a fixing unit 160 fuses the transferred image onto the printing medium by applying relatively high temperature and high pressure.

Hereinbelow, the developer collecting apparatus 200 will be described in detail with reference to FIGS. 2-4.

Figure 2:
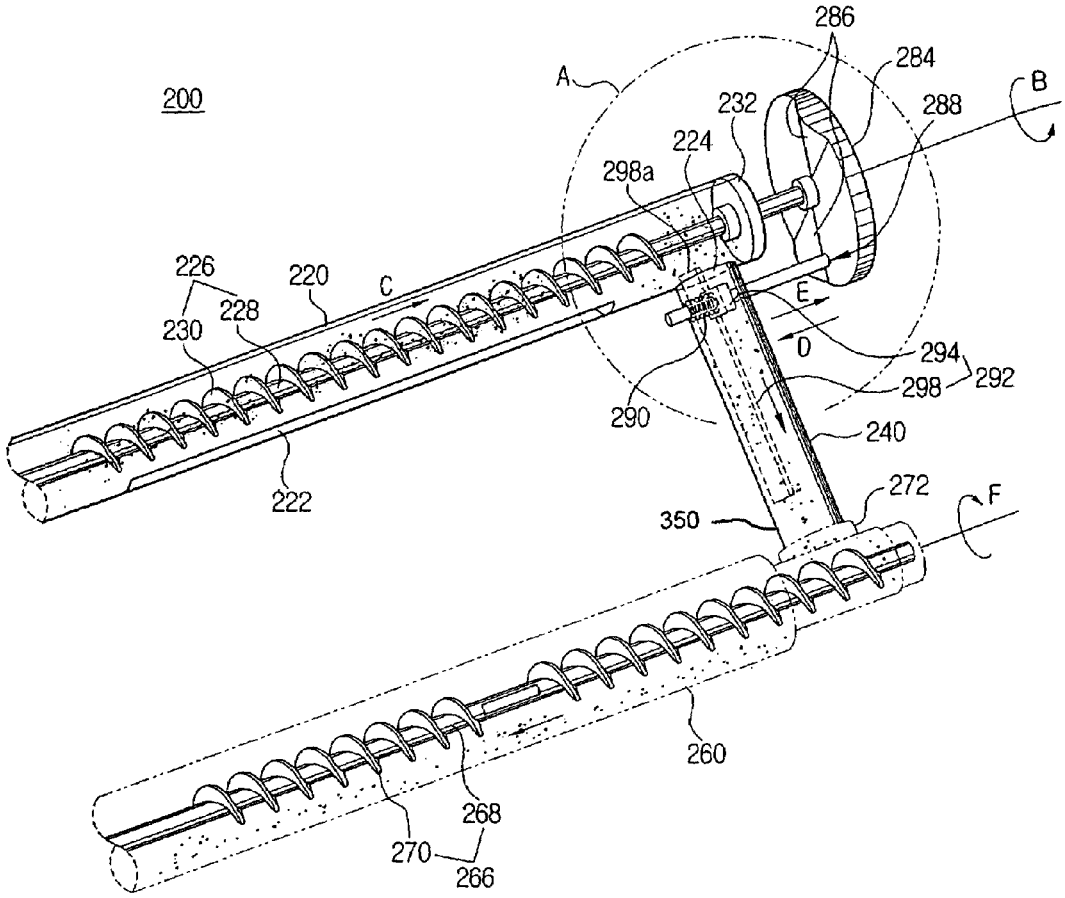
FIG. 2 is a perspective view schematically showing the main parts of FIG. 1.
Figure 3:
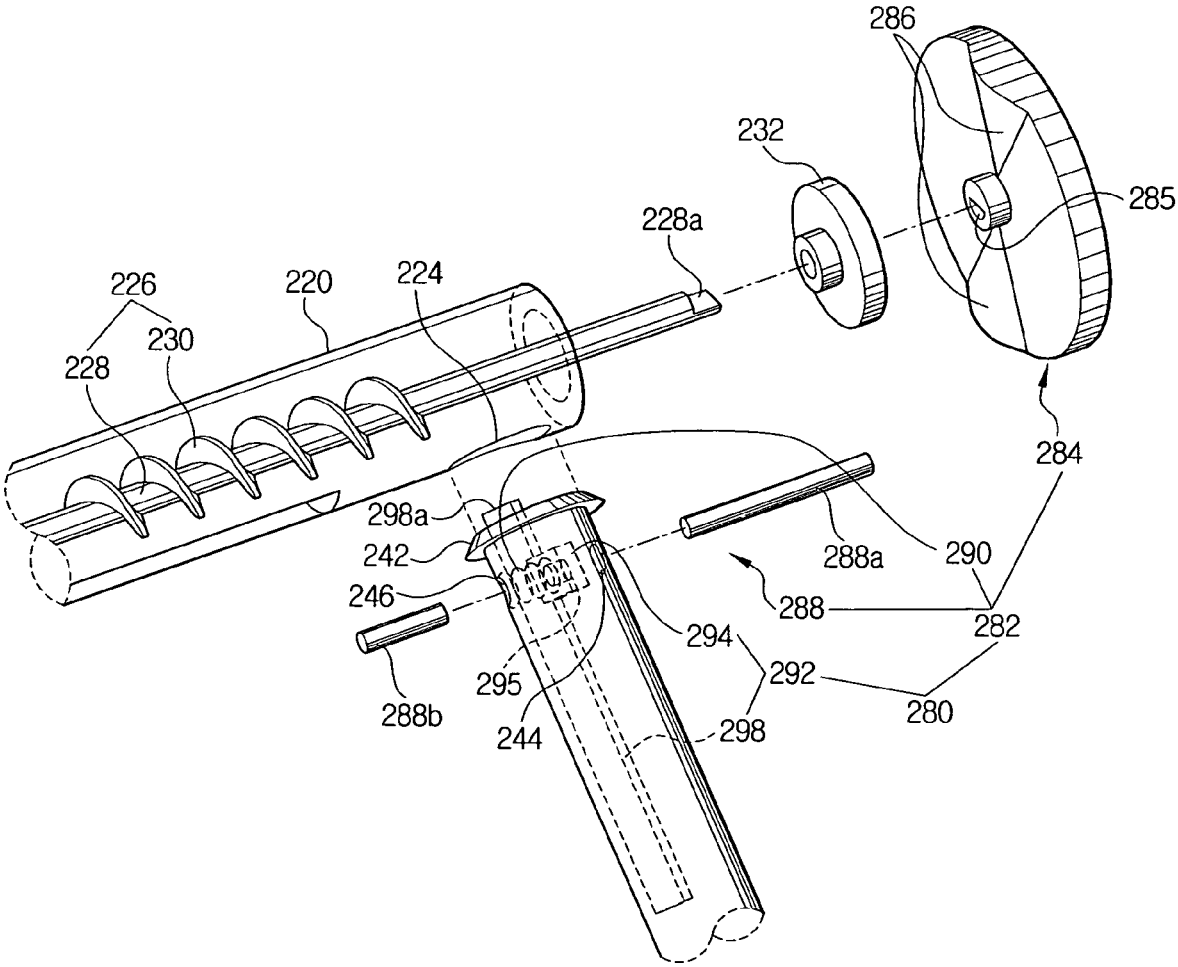
FIG. 3 is an exploded and perspective view, enlarging a portion 'A' of FIG. 2.
Figure 4:
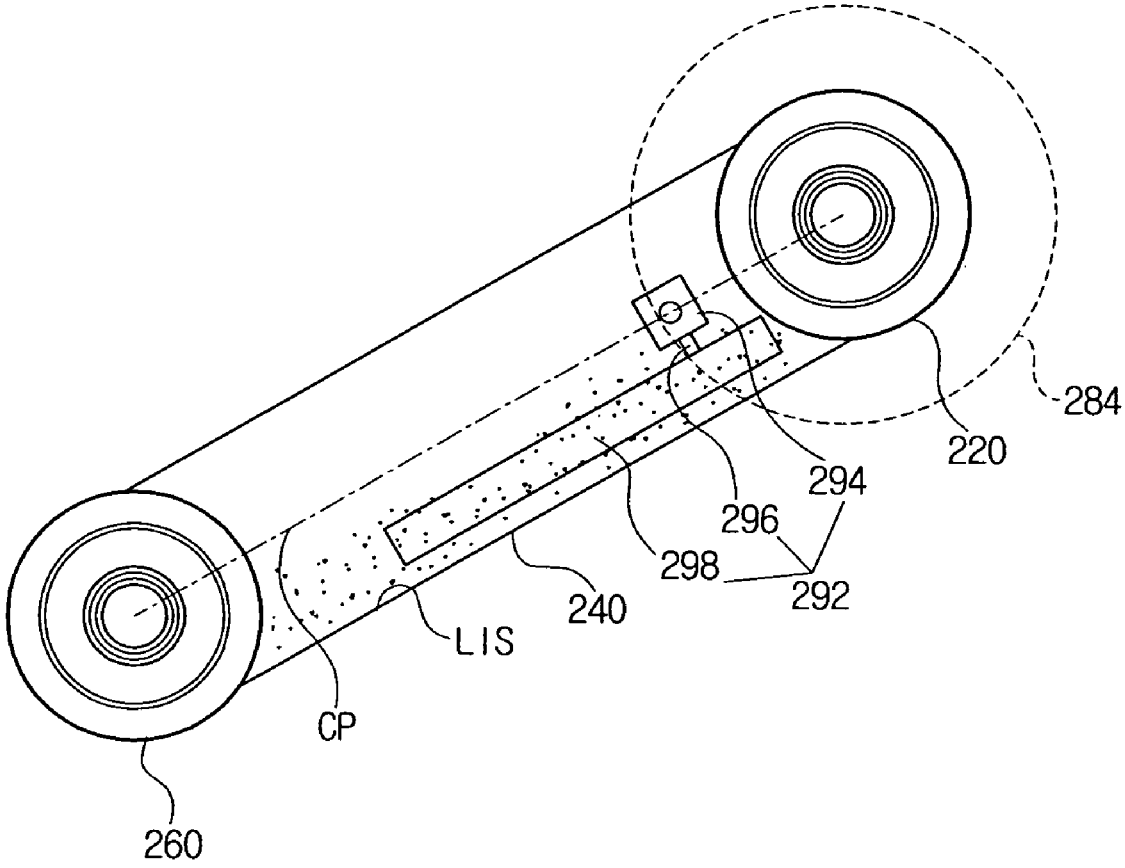
FIG. 4 is a longitudinal sectional view schematically showing the main parts of FIG. 2.

Referring to FIGS. 2-4, the developer collecting apparatus 200 comprises a developer collecting container 220, a transport pipe 240, a developer storing container 260 and a vibration unit 280.

The developer collecting container 220 includes an inlet 222 for collecting the unused developer by the cleaning member 190. The developer collecting container 220 also includes an outlet 224 formed on one side thereof for discharging the collected developer to the transport pipe 240. In the developer collecting container 220, a first transport member 226 is rotatably mounted to move the collected developer toward the outlet 224. One end of the first transport member 226 is rotatably supported by a bush 232, while the other end is connected to a driving source (not shown). The first transport member 226 preferably includes an auger comprising a first shaft 228 and a first rib 230 spirally formed on a circumference of the first shaft 228.

The transport pipe 240 is preferably a tubular member positioned at an angle to link the developer collecting container 220 and the developer storing container 260 disposed under the developer collecting container 220. A hook portion 242 is formed on the transport pipe 240 to engage with the outlet 224 of the developer collecting container 220. A lower end of the transport pipe 350 is inserted in a developer storing container inlet 272 formed on the developer storing container 260. However, the transport pipe 240 may be connected to the developer collecting container 220 and the developer storing container 260 by other suitable arrangements and constructions such as by press-fit. According to the above structure, the developer moved to the outlet 224 of the developer collecting container 220 may gravitate by its own weight to the developer storing container 260 through the transport pipe 240.

The developer storing container 260 is mounted on one side of a housing 142 (FIG. 1) of the developing unit 140 to receive the developer. In the developer storing container 260, a second transport member 266 for moving the developer is mounted. In the same manner as the first transport member 226, the second transport member 266, preferably including an auger, comprising a second shaft 268 and a second rib 270 spirally formed on a circumference of the second shaft 268. The developer moved from the transport pipe 240 is then moved into the developer storing container 260 by the second transport member 266. Thus, the moved developer is supplied again to the photoconductive medium 120 (FIG. 1) by a transfer roller 144 (FIG. 1) of the developing unit 140. The second transport member 266 may be used as an agitator as well, to mix the developer already stored in the developer storing container 260 and the collected developer.

The vibration unit 280 comprises a vibrator 292 and a vibrator driver 282 to vibrate the vibrator 292.

The vibrator 292 comprises a vibrator body 294, a connection rib 296 (FIG. 4) and a vibration rib 298. These components may be integrally formed by injection molding.

The vibrator body 294 has a connection hole 295 transversely formed therethrough for connection with the vibrator driver 282. The connection rib 296 is connected to the vibrator body 294 by one end and to the vibration rib 298 by the other end. Thus, the vibrator body 294 and the vibration rib 298 are interconnected.

An upper end 298*a* of the vibration rib 298 extends into the developer collecting container 220 through the inlet 224. A lower end is extends to a lower part of the transport pipe 240. As shown in FIG. 4, the vibration rib 298 is disposed below a central plane CP of the transport pipe 240. More specifically, the vibration rib 298 is positioned between the central portion CP and a lower inner surface LIS (FIG. 4) of the transport pipe 240. This is to prevent the developer from flowing into the inlet 224 and gravitating along the lower inner surface LIS of the transport pipe 240 from clotting and adhering in the lower inner surface LIS. The vibration rib 298 of the present embodiment is preferably formed as a rib or a rod; however, other suitable arrangements and constructions maybe used. Additionally, a flexible blade may be provided on one side of the vibration rib 298.

The vibrator driver 282 comprises a pulley 284, a vibrating rod 288 and a spring 290.

The pulley 284 engages with one end of the shaft of the first transport member 226 to thereby rotate together with the first transport member 226. The one end of the first shaft 228 has a stepped portion 228*a* for engagement with a shaft hole 285 of the pulley 284. The shaft hole 285 has a corresponding shape to facilate engagement with the stepped portion 228*a*. Therefore, rotary power of the first shaft 228 may be transmitted to the pulley 284. However, differently from this embodiment, the first shaft 228 and the shaft hole 285 of the pulley 284 may be coupled by a press-fit. In addition, the pulley 284 includes a pair of cam parts 286 which protrude on one side thereof to convert the rotary movement of the pulley 284 into a linear movement of the vibrating rod 288.

The vibrating rod 288 is slidably mounted to the transport pipe 240 and comprises a first vibrating rod 288*a* and a second vibrating rod 288*b*. The first vibrating rod 288*a* is inserted in a sliding manner into a first supporting hole 244 formed on one side of the transport pipe 240. One end of the first vibrating rod 288*a* fits into the connection hole 295 formed on the vibrator body 294. The other end of the first vibrating rod 288*a* contacts with the one side of the pulley 284. Thus, when the pulley rotates, the first vibrating rod 288*a* may be linearly reciprocated by the cam parts 286 sliding through the transport pipe 240. The second vibrating rod 288*b* is slidably supported by a second support hole 246 formed on the opposite side of the transport pipe 240. One end of the second vibrating rod 288*b* fits into the vibrator body 294. Therefore, the first and the second vibrating rods

288*a* and 288*b* may reciprocate together with the vibrator body 294, which is preferably fixed to the vibrator body 294.

The spring 290 fits around the second vibrating rod 288*b*. One end of the spring 290 is supported by an inner wall of the transport pipe 240, while the other end is supported by the vibrator body 294. Therefore, when the second vibrating rod 288*b* and the vibrator body 294 reciprocate, the spring 290 extends and contracts on an outer circumference of the second vibrating rod 288*b*. Consequently, shown in FIG. 2, the vibrator body 294 is biased in a direction 'E'.

Hereinbelow, the operation of the developer collecting apparatus of an image forming apparatus will be described in reference to FIGS. 2-4.

The cleaning member 190 (FIG. 1) removes the unused developer by scraping the photoconductive medium 120 (FIG. 1). The removed developer is collected into the developer collecting container 220. The first transport member 226 rotates in the 'B' direction as indicated in FIG. 2. Accordingly, the first transport member 226 moves the developer in a 'C' direction from the developer collecting container 220 to the outlet 224 of the developer collecting container 220.

When the first transport member 226 rotates in the 'B' direction, the pulley 284 connected to the one end of the first shaft 228 is also rotated in the 'B' direction. Accordingly, the first vibrating rod 288*a* (FIG. 3) in contact with the one surface of the pulley 284 is moved by the cam parts 286 in the 'D' direction. Therefore, the vibrator body 294 and the second vibrating rod 288*b* (FIG. 3) fixed to the vibrator body 294 move in the 'D' direction. Consequently, the spring 290 contracts in the 'D' direction. If the pulley 284 further rotates, the one end of the first vibrating rod 288*a* passes by the cam parts 286. Therefore, the spring 290 pushes the vibrator body 294 out in the 'E' direction. As the pulley 284 keeps rotating, such processes are repeated. As a result, the vibrator 292 in the transport pipe 240 shakes the developer.

Upon being shaken by the vibrator 292, the developer that reaches the outlet 224 of the developer collecting container 220 may flow into the transport pipe 240 through the outlet 224 without clotting and adhering in the outlet 224. More specifically, the developer flowing into the transport pipe 240 gravitates along the lower inner surface LIS of the transport pipe 240. During this process, the developer may clot on the lower inner surface LIS of the transport pipe 240. However, since the vibrator 292 shakes the developer moving along the lower inner surface LIS of the transport pipe 240, the developer can still travel fluently. When the developer which moves through the transport pipe 240 flows to the inlet 222 of the developer collecting container 220, the second transport member 266 rotates in the 'F' direction as indicated in FIG. 2. Accordingly, the second transport member 266 moves the developer into the developer storing container 260. The developer moved to the developer storing container 260 is mixed with a developer already stored in the developer storing container 260 by an agitator 145 (FIG. 1) and supplied to the developing roller 140 (FIG. 1).

As described above, because an upper end of the vibrator 292 extends up to an inside of the developer collecting container 220 through the outlet 224, the developer is prevented from accumulating at the outlet 224.

Also, since the vibrator 292 is disposed near the lower inner surface LIS of the transport pipe 240, accumulation of the developer may be more effectively restrained.

Furthermore, since the rotary power of the first transport member 226 is used to shake the vibrator 292, the structure of the developer collecting apparatus can be relatively simplified.

While the invention has been shown and described with reference to certain embodiments thereof, it will be understood by those skilled in the art that various changes in form and details may be made therein without departing from the spirit and scope of the invention as defined by the appended claims.

What is claimed is:

1. A developer collecting apparatus comprising:

a developer collecting container comprising an inlet for inflow of a developer removed from a photoconductive medium by a cleaning member, and an outlet for discharge of the developer;

a developer storing container connected to the developer collecting container through a transport pipe; and a vibration unit preventing the developer from clotting or accumulating at the outlet of the developer collecting container and in the transport pipe, wherein the vibration unit comprises a vibrator mounted in the transport pipe to shake the developer, and a vibrator driver located outside of the transport pipe and driving the vibrator.

2. The developer collecting apparatus of claim 1, comprising:

a first transport member mounted in the developer collecting container to move the developer drawn in through the inlet; and a second transport member mounted in the developer storing container.

3. The developer collecting apparatus of claim 2, wherein the first and the second transport members respectively comprise an auger.

4. The developer collecting apparatus of claim 2, wherein the vibrator driver transmits power from the first transport member to thereby vibrate the vibrator.

5. A developer collecting apparatus comprising:

a developer collecting container comprising an inlet for inflow of a developer removed from a photoconductive medium by a cleaning member, and an outlet for discharge of the developer;

a developer storing container connected to the developer collecting container through a transport pipe; and a vibration unit preventing the developer from clotting or accumulating at the outlet of the developer collecting container and in the transport pipe;

a first transport member mounted in the developer collecting container to move the developer drawn in through the inlet; and a second transport member mounted in the developer storing container, wherein the vibration unit comprises a vibrator mounted in the transport pipe to shake the developer, and a vibrator driver transmitted with power from the first transport member to thereby vibrate the vibrator, and the vibrator comprises a vibrator body, a connection rib connected to the vibrator body on one end thereof, and a vibration rib connected to the other end of the connection rib.

6. The developer collecting apparatus of claim 5, wherein the vibrator driver comprises:

a pulley rotating in connection with a shaft of the first transport member and having at least one cam part on one side thereof;

a vibrating rod engaged with the vibrator body to contact with the one side of the pulley; and a spring interposed between the vibrator body and an inner surface of the transport pipe to resiliently support the vibrator body in one direction.

7. The developer collecting apparatus of claim 5, wherein an upper end of the vibration rib extends substantially upwards toward an inside of the developer collecting container through the outlet.

8. The developer collecting apparatus of claim 5, wherein at least a portion of the vibration rib is disposed between a central portion and a lower inner surface of the transport pipe.

9. A developer collecting apparatus comprising:

a developer collecting container including an inlet for inflow of a developer removed from a photoconductive medium by a cleaning member, and an outlet for discharge of the developer;

a developer storing container storing the developer discharged from the developer collecting container;

a transport pipe connecting the developer collecting container and the developer storing container; and a vibrator mounted in the transport pipe shaking the developer in the transport pipe by a power transmitted directly from outside of the transport pipe.

10. The developer collecting apparatus of claim 9, wherein the vibrator comprises:

a vibrator body connected by the external power;

a connection rib connected to the vibrator body by one end thereof; and a vibration rib connected to the other end of the connection rib.

11. The developer collecting apparatus of claim 10, wherein an upper end of the vibration rib extends substantially upwards toward an inside of the developer collecting container through the outlet.

12. The developer collecting apparatus of claim 11, wherein at least a portion of the vibration rib is disposed between a central portion and a lower inner surface of the transport pipe.

13. An image forming apparatus comprising:

a photoconductive medium whereon a predetermined electrostatic latent image is formed;

a developing unit developing the electrostatic latent image on the photoconductive medium into a visible image;

a transfer unit transferring the visible image onto printing paper; and a developer collecting apparatus withdrawing a developer unused during the transferring process on the photoconductive medium to the developing unit, wherein the developer collecting apparatus comprises, a cleaning member removing the developer remaining on the photoconductive medium, a developer collecting container having an inlet for inflow of the removed developer and an outlet for discharge of the developer, a developer storing container connected to the developer collecting container through a transport pipe; and a vibration unit shaking the developer to prevent the developer from clotting and accumulating at the outlet of the developer collecting container and in the transport pipe, wherein the vibration unit comprises a vibrator mounted in the transport pipe, to shake the developer.

14. The image forming apparatus of claim 13, comprising:

a first transport member mounted in the developer collecting container to move the developer drawn in through the inlet to the outlet; and a second transport member mounted in the developer storing container, and wherein the vibration unit is driven in association with the operation of the first transport member.

15. The image forming apparatus of claim 14, wherein the vibration unit further comprises:

a vibrator driver for driving the vibrator, wherein the vibrator is movably supported in the transport pipe.

16. An image forming apparatus comprising:

a photoconductive medium whereon a predetermined electrostatic latent image is formed;

a developing unit for developing the electrostatic latent image on the photoconductive medium into a visible image;

a transfer unit for transferring the visible image onto printing paper; and a developer collecting apparatus for withdrawing a developer unused during the transferring process on the photoconductive medium to the developing unit, wherein the developer collecting apparatus comprises a cleaning member for removing the developer remaining on the photoconductive medium, a developer collecting container having an inlet for inflow of the removed developer and an outlet for discharge of the developer, a developer storing container connected to the developer collecting container through a transport pipe, a vibration unit shaking the developer to prevent the developer from clotting and accumulating at the outlet of the developer collecting container and in the transport pipe, a first transport member mounted in the developer collecting container to move the developer drawn in through the inlet to the outlet, and a second transport member mounted in the developer storing container, the vibration unit is driven in association with the operation of the first transport member, the vibration unit comprises a vibrator movably supported in the transport pipe, and a vibrator driver driving the vibrator, and the vibrator comprises a vibrator body vibrated by the vibrator driver, a connection rib connected to the vibrator body at one end thereof, and a vibration rib connected to the other end of the connection rib.

17. The image forming apparatus of claim 16, wherein the vibrator driver comprises:

a pulley rotating in connection with a shaft of the first transport member and having at least one cam part on one side thereof;

a vibrating rod engaged with the vibrator body to contact with the one side of the pulley; and a spring interposed between the vibrator body and an inner surface of the transport pipe to resiliently support the vibrator body in one direction.

18. The image forming apparatus of claim 17, wherein an upper end of the vibration rib extends substantially upwards toward an inside of the developer collecting container through the outlet, and at least a part of the vibration rib is disposed between a central portion and a lower inner surface of the transport pipe.

* * * * *